United States Patent [19]

Lacore

[11] Patent Number: 4,527,295

[45] Date of Patent: Jul. 9, 1985

[54] TANK FLUSHING APPARATUS

[76] Inventor: Brian C. Lacore, 9777 Soledad Canyon Rd., Canyon Country, Calif. 91351

[21] Appl. No.: 616,127

[22] Filed: Jun. 1, 1984

[51] Int. Cl.[3] ..... E03D 1/00

[52] U.S. Cl. ..... 4/321; 4/300; 4/323; 4/661

[58] Field of Search ..... 4/321, 300, 661, 323, 4/322, 317, 319, 353, 458, 490, 492; 134/198, 168 R, 200, 166 R, 177, 167 R, 186, 169 R; 210/221.1

[56] References Cited

U.S. PATENT DOCUMENTS

| | | | |
|---|---|---|---|
| 1,687,012 | 10/1928 | Forth | 134/166 R |
| 1,799,525 | 4/1931 | Morgan | 134/177 X |
| 2,526,265 | 10/1950 | Nulph | 134/198 X |
| 2,679,853 | 6/1954 | Bryant | 134/166 R |
| 2,896,642 | 7/1959 | Lilly | 134/177 X |
| 3,001,533 | 9/1961 | Holdren | 134/166 R |
| 3,031,148 | 4/1962 | Holdren | 134/166 R X |
| 3,079,937 | 3/1963 | Tooper et al. | 134/166 R |
| 3,447,966 | 6/1969 | Manno | 134/198 X |
| 3,922,730 | 12/1975 | Kemper | 4/317 |
| 3,995,328 | 12/1976 | Carolan et al. | 4/316 |
| 4,042,981 | 8/1977 | Cook | 4/458 |
| 4,107,798 | 8/1978 | Lamb et al. | 4/321 |
| 4,183,105 | 1/1980 | Womack | 4/300 |
| 4,241,464 | 12/1980 | Buckwalter | 4/492 |
| 4,391,002 | 7/1983 | Marti | 4/321 |
| 4,449,258 | 5/1984 | Ackermann et al. | 4/300 |

FOREIGN PATENT DOCUMENTS

| | | | |
|---|---|---|---|
| 1080168 | 8/1967 | United Kingdom | 134/177 |

*Primary Examiner*—Henry K. Artis
*Attorney, Agent, or Firm*—Jack C. Munro

[57] ABSTRACT

A tank flushing apparatus designed in particular to be utilized in conjunction with a toilet waste holding tank. The tank flushing apparatus includes a connector assembly to facilitate attachment to a hose which in turn extends from a source of liquid, such as water. The connector assembly is attached to an elongated conduit, the inner end of which is formed into a nozzle assembly. The nozzle assembly extends through a hole formed within the holding tank and is constructed also to form a liquid type connection with the tank. The nozzle assembly includes a nozzle tip which disperses streams of water at various angles of inclination within the holding tank so as to achieve even dispersement of the liquid for the purpose of the dislodging and moving solid waste matter contained within the tank to then be moved through a drain conduit and discharged exteriorly of the holding tank at a desired location.

11 Claims, 4 Drawing Figures

TANK FLUSHING APPARATUS

BACKGROUND OF THE INVENTION

The field of this invention relates to holding tanks for the combination of liquid and solid matter in which the holding tank is to be occasionally emptied. More particular the structure of this invention is designed to be incorporated with the holding tank to facilitate removal of solid material which has been accumulated within the holding tank as the holding tank is being drained.

The structure of the present invention is designed in particular to be used in conjunction with toilet waste tanks. However, it is considered to be within the scope of this invention to use this invention within any kind of tank which is used to collect a combination of liquid and solid matter and that tank is occasionally emptied.

It is common to utilize a toilet within a vehicle, such as a recreational vehicle. The normal procedure for such toilets is that they discharge the waste into a holding tank which is contained within the vehicle. Periodically, the holding tank is emptied into a conventional sewage system. Throughout the country there are a large number of campgrounds which are for the purpose of accommodating the needs of recreational vehicles and their occupants. These campgrounds generally include a holding tank disposal location.

The normal procedure for the disposal of the holding tank is for the operator to disconnect a drain cap from a drain pipe which is connected to the holding tank. The drain pipe then discharges the accumulated matter within the holding tank into a the sewage system or a further holding tank located within the campgrounds. However, solid matter (feces) tends to remain within the holding tank and does not readily drain through the drain pipe. If the solid matter is not removed, excessive noxious odor will be created which will pass through the opening within the toilet (water closet) and into the air space located within the recreational vehicle. Chemicals can be added within the holding tank in order to diminish this creation of noxious odor. However, the chemicals, even if a substantial amount is used, can never completely get rid of these odors. Further, the excessive use of chemicals can get to be a relatively expensive procedure.

It is common in the emptying of the holding tank within the vehicle that a fresh water hose, that is connected to a pressurized supply of fresh water (which is usually located at the campgrounds directly adjacent the disposal facility), be conducted within the recreational vehicle and then inserted by the operator through the opening in the toilet and physically maneuvered so as to emit a forced stream of water through the hose to different parts of the holding tank to remove accumulated solid matter. The solid matter is then washed through the drain pipe and then emptied into the disposal facility. However, the opening within the toilet is quite small and it is difficult for the operator to orient the hose to "all the nooks and crannies" of the holding tank in order to achieve complete removal of the solid matter. Additionally, for one to have one's hand within the drain pipe of the toilet is not exactly the most desirable procedure. Still further, the operator is forced to breathe the noxious odors while performing this task which is certainly not pleasant. Still further, the dragging of a hose into and out of the recreational vehicle frequently causes spillage of the water within the hose on the carpet and other furnishings within the vehicle.

SUMMARY OF THE INVENTION

The primary objective of the present invention is to incorporate within a water closet holding tank of a recreational vehicle a device which facilitates complete and thorough flushing of the holding tank as the holding tank is being emptied at a disposal facility.

Another objective of this invention is to construct a holding tank flushing apparatus which can be manufactured inexpensively, and therefore, available to the ultimate consumer at a relatively inexpensive price.

Another objective of this invention is to construct a holding tank flushing apparatus which is designed to operate most efficiently in achieving complete removal of solid waste material within a holding tank.

Another objective of this invention is by achieving complete removal of the solid waste material within a holding tank that a substantial decrease is experienced in the amount of chemicals that are required to be used within the holding tank and therefore, less expense is experienced by the operator of the recreational vehicle.

The tank flushing apparatus of the present invention is designed to be mounted in conjunction with a waste holding tank wherein there is provided a drain pipe for the holding tank to drain the contents from the holding tank to a separate deposit location. The tank flushing apparatus includes a nozzle assembly which includes a grouping of openings through which the flushing liquid is to be forced forming a plurality of streams. These streams are directed to different areas of the holding tank. The nozzle is mounted through a hole that is formed in the bottom of the holding tank. An attaching flange is mounted adjacent the nozzle. The attaching flange is secured to the bottom surface of the holding tank forming a liquid tight connection therebetween. The nozzle is connected through a conduit to a one-way valve assembly which permits liquid to be moved through the conduit only in the direction to within the interior of the tank. The one-way valve assembly is attached to a hose connector, the hose connector is in turn fixed in position to a portion of the structure that supports the holding tank. A separate length of hose which is connected to a source of supply of liquid is to be connected to the hose connector.

DETAILED DESCRIPTION OF THE SHOWN EMBODIMENT

Figure 1:
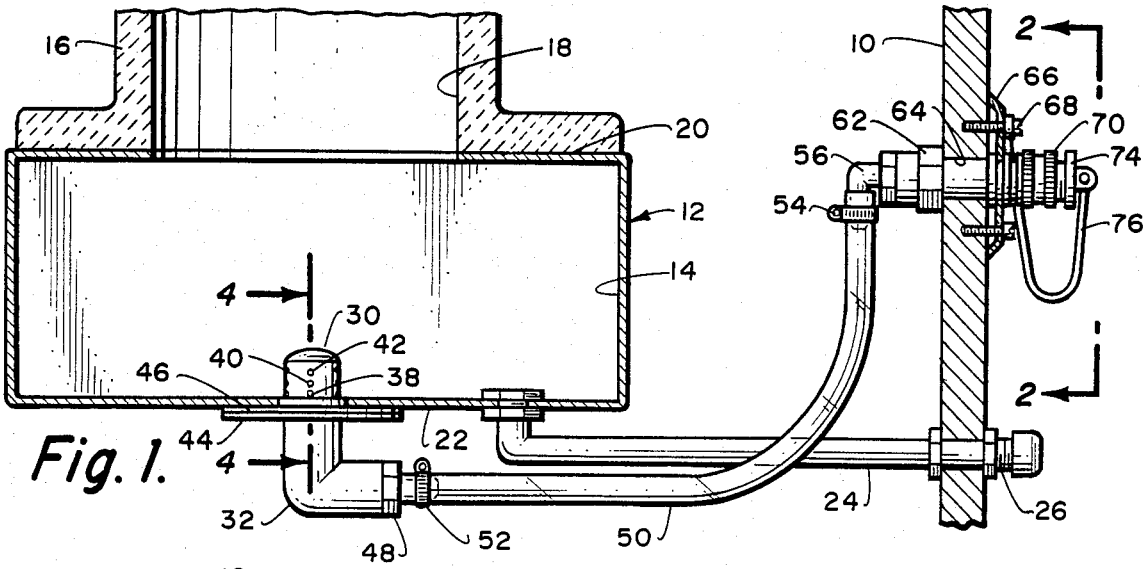
FIG. 1 is a side elevational view, partly in cross-section, of the tank flushing apparatus of the present invention depicting such as it would be installed in a typical waste holding tank of a recreational vehicle.
Figure 2:
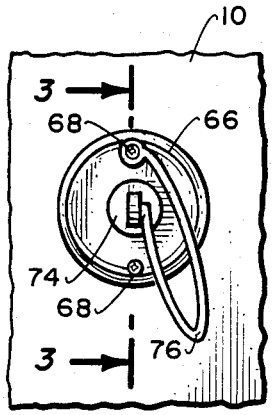
FIG. 2 is an end view of the hose type of connection which is mounted within the sidewall of the recreational vehicle through which the supply water hose is to be connected to supply the water necessary for the tank flushing apparatus of this invention.
Figure 4:
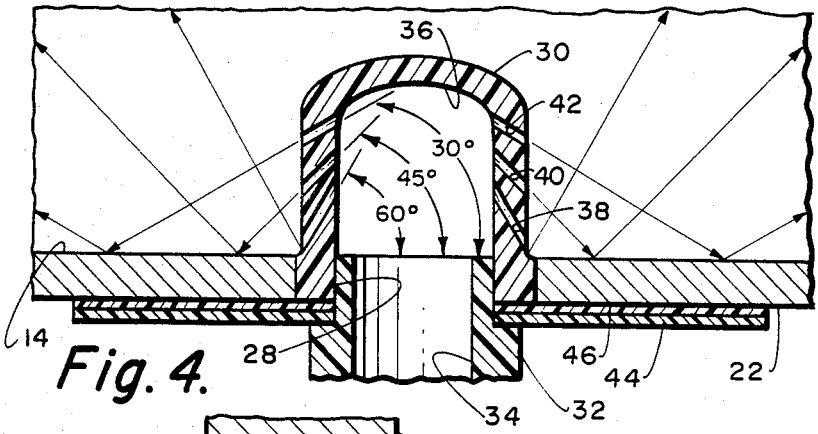
FIG. 4 is a cross-sectional view taken through the nozzle assembly of the tank flushing apparatus of this invention taken along line 4—4 of FIG. 1.
Figure 3:
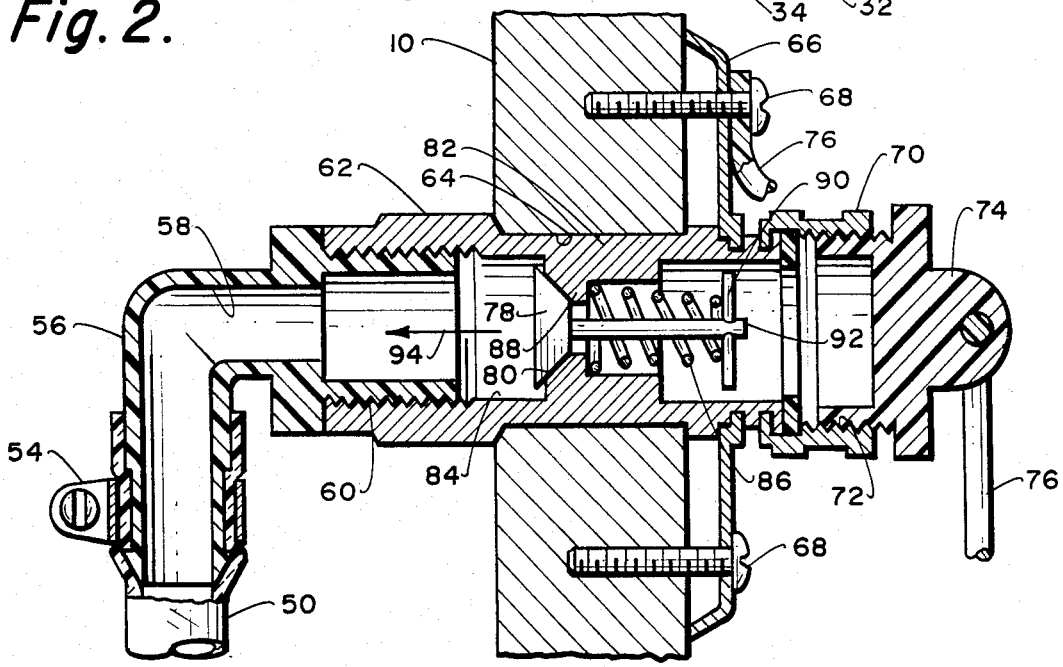
FIG. 3 is a cross-sectional view taken through a one-way valve assembly included within the tank flushing apparatus of this invention.

Referring particularly to the drawing there is shown a conventional recreational vehicle sidewall 10 which is mounted on a conventional vehicle supporting structure, such as a frame (not shown). Also mounted in conjunction with the frame is a waste holding tank 12. The tank 12 is basically in the shape of a box and has an interior chamber 14. The tank 12 is to be mounted within the structure of the recreational vehicle so as to be located beneath a conventional toilet bowl 16. The toilet bowl 16 has an outlet 18 through which waste is to be discharged from the toilet bowl 16. The bowl 16 connects with the upper wall 20 of the tank 12 with the outlet opening 18 extending within the internal chamber 14 of the tank 12.

Formed within the bottom wall 22 of the tank 12 is a drain pipe 24. The drain pipe 24 is designed to receive the contents of the interior chamber 14 and conduct such through the pipe 24 through a drain hose connector 26 to drain hose (not shown). The drain hose would normally be included within the drain location to guide the waste material either into a sewage facility or a separate holding tank mounted within a campground or other similar facility. The drain hose connector 26 is fixedly mounted within the recreational vehicle wall 10.

It is to be understood that the configuration of the tank 12 in actual practice would not be the configuration shown. Actually, the tank will be constructed so that matter contained within the tank is naturally directed into the drain pipe 24. Therefore, the bottom wall 22, as well as possibly the sidewalls of the tank 12, would be constructed so as to be tapered in order to facilitate the draining into the pipe 24. However, there must be at least a small section of planar surface of the bottom wall 22 through which a hole 28 is to be formed.

The hole 28 is to be of a size to just tightly facilitate entry of a nozzle tip 30. The nozzle tip 30 would normally be constructed of a plastic material. The nozzle tip 30 is mounted on an elbow 32. A passageway 34 extends through the elbow 32 and connects with a connecting passageway 36 formed within the nozzle tip 30. The nozzle tip 30 includes a first series of openings which is formed of a group of openings 38 located in an annular pattern about the nozzle tip 30. The openings 38 are located closest to the interior surface of the bottom wall 22. These openings 38 are inclined with the preferable angle of inclination being about sixty degrees in respect to the planar surface of the bottom wall 22. Normally, there will be four to eight in number of the openings 38.

Located spaced a short distance from the openings 38 are a second series of openings which are defined as openings 40. Openings 40 are again located in an annular pattern about the nozzle tip 30. Again, there will be four to eight in number of openings 40. The longitudinal center axis of the openings 40 is to be inclined at approximately forty-five degrees in respect to the planar surface of the bottom wall 22.

Located closest to the outer free end of the nozzle tip 30 is a third series of openings formed by openings 42. Normally, there will be, again, four to eight in number of openings 42 located in an annular spaced-apart arrangement about the tip 30. The openings 42, as well as openings 40 and 38, may or may not be evenly spaced-apart. The longitudinal center axis of each of the openings 42 is to be located at approximately a thirty degree angle in respect to the planar surface of the bottom wall 22.

As a result, water which is conducted through the passageways 34 and 36 is caused to be ejected into a plurality of streams through the openings 38, 40 and 42. Because of the different inclination of the openings 38, 40 and 42, the streams of water are dispensed with a great amount of force to practically the entire lower portion of the holding tank 20. Therefore, any accumulated sediment, which generally is in the form of solid waste, will be moved and caused to flow into the drain pipe 24.

Fixedly mounted on the elbow 32 directly adjacent the nozzle tip 30 is a flat annular disc which is to be defined as an annular flange 44. The inner surface of the annular flange 44 will normally be roughened as well as the exterior surface of the bottom wall 22 located about the hole 28. An adhesive 46 is to be located on the roughened surface of the flange 44 and then placed in contact with the exterior surface of the bottom wall 22 where the adhesive 46 will fixedly secure in a liquid tight manner the nozzle tip 30 and elbow 32 onto the bottom wall 22 of the holding tank 12.

The free end of the elbow 32 is formed into a necked down area 48. The necked down area 48 is to be fixedly secured to a flexible conduit (usually plastic) 50. The attachment of the conduit 50 to the necked down end 48 will normally be by conventional means such as an adjustable band clamp 52.

The outer end of the conduit 50 is similarly attached by a similar band clamp 54 to an elbow 56. In installing the conduit 50 according to the individual installation, a precise length of the conduit 50 is to be selected so there will not be an excessive amount. Within the elbow 56 is located a passageway 58. The outer end of the elbow 56 is formed into a threaded section 60. Threadably secured on the threaded section 60 is a sleeve 62. The exterior surface of the sleeve 62 is mounted in a tight fitting manner within hole 64 formed within the sidewall 10 of the recreational vehicle.

The outer end of the sleeve 62 is fixedly secured to a mounting flange 66. The mounting flange 66 is fixedly mounted within the sidewall 10 by a means of conventional bolt fastener 68. The very outer end of the sleeve 62 is connected to a hose connector 70 which has internal screw threads 72. When not in use, plug 74 is threadably secured with the thread 72 in a tight fitting manner to prevent entry of any foreign material. The plug 74 is connected to a lanyard 76. The free outer end of the lanyard 76 is attached by one of the fasteners 68 to thereby prevent loosing of the plug 74 when it has been removed from the hose connector 70.

It is to be understood that a hose (not shown) is to be threadably connected with the threads 72 from a source of pressurized liquid which is usually water. This liquid under pressure acts against conically shaped valve member 78 to unseat such from valve seat 80. Valve seat 80 is formed within valve housing 82 which is fixedly mounted within internal passsage 84 formed within the sleeve 62. The unseating of valve member 78 is against the biasing action of coil spring 86 which is mounted between shoulder 88 and rod 90. Rod 90 is fixedly mounted at the outer end of a stem 92 which is fixedly secured and extends from the valve member 78.

The function of this one-way valve assembly is so that liquid is only permitted to move in the direction of arrow 94 so that it would not be possible for any contaminated material to be dispensed from the conduit 50. It is to be noted that sleeve 62 is to be mounted in substantial alignment with the top wall 20 of the tank 12. This is so that gravity will also not permit any waste matter to be conducted through the conduit 50 to even be located directly adjacent the one-way valve assembly.

What is claimed is:

1. In combination with a tank, said tank having an interior chamber, said tank having a bottom wall, contents including solid matter to be deposited within said interior chamber, a drain conduit assembly connected to said tank, said drain conduit assembly being for the purpose of discharging said contents exteriorly of said tank, a tank flushing apparatus connected to said tank, said tank flushing apparatus comprising:

a nozzle assembly mounted through said bottom wall of said tank, said nozzle assembly for dispensing of a liquid within said internal chamber, said nozzle assembly having a nozzle tip, said nozzle tip being located within said internal chamber, said nozzle tip including means for dispersement of said liquid within said internal chamber;

a conduit assembly having an inner end and an outer end, said inner end being connected to said nozzle assembly, said outer end being connected to a connector assembly, said connector assembly being adapted to connect with said liquid, whereby a pressurized amount of said liquid is to be conducted through said connector assembly and said conduit assembly to said nozzle assembly to then be forcibly dispensed within said internal chamber to thereby cause said solid matter to move within said internal chamber into said drain conduit assembly and hence be discharged exteriorly of said tank; and said means for dispersement of said liquid comprising a series of discharge openings, each said discharge opening having a longitudinal center axis, at least some of said longitudinal center axes being located at various angular inclinations relative to said nozzle tip to thereby direct said liquid to different sections of said interior chamber so as to effect even dispersement of said liquid.

2. The combination as defined in claim 1, wherein:

said discharge openings being divided into a first series of openings and a second series of openings and a third series of openings, each said series of openings being located in an annular spaced-apart pattern within said nozzle tip, said first series of openings being located at a first angle of inclination, said second series of openings being located at a second angle of inclination, said third series of openings being located at a third angle of inclination, said second angle of inclination being different from said first angle of inclination, said third angle of inclination being different from said first and second angles of inclinations.

3. The combination as defined in claim 2 wherein:

said bottom wall being planar, said first angle of inclination being at a sixty degree angle relative to said planar surface of said bottom wall, said second angle of inclination being forty-five degrees relative to the planar surface of said bottom wall, said first angle of inclination being thirty degrees relative to the said planar surface of said bottom wall.

4. The combination as defined in claim 1 wherein:

said nozzle assembly including an attaching plate, said attaching plate being located directly adjacent said nozzle tip, said attaching plate to abut against the exterior surface of said bottom wall, fastening means to connect between said attaching plate and said bottom wall to fix in position said attaching plate on said bottom wall.

5. The combination as defined in claim 4 wherein:

said fixing means comprising an adhesive.

6. The combination as defined in claim 1 wherein:

said conduit assembly including an elongated length of flexible conduit.

7. The combination as defined in claim 1 wherein:

said connector assembly including a one-way valve which only permits liquid within said conduit assembly to move in the direction towards said nozzle assembly.

8. The combination as defined in claim 3 wherein:

said nozzle assembly including an attaching plate, said attaching plate being located directly adjacent said nozzle tip, said attaching plate to abut against the exterior surface of said bottom wall, fastening means to connect between said attaching plate and said bottom wall to fix in position said attaching plate on said bottom wall.

9. The combination as defined in claim 8 wherein:

said fixing means comprising an adhesive.

10. The combination as defined in claim 9 wherein:

said conduit assembly including an elongated length of flexible conduit.

11. The combination as defined in claim 10 wherein:

said connector assembly including a one-way valve which only permits liquid within said conduit assembly to move in the direction towards said nozzle assembly.

* * * * *